US008460081B2

(12) United States Patent
Meyer

(10) Patent No.: US 8,460,081 B2
(45) Date of Patent: Jun. 11, 2013

(54) GRID-BASED MULTI-LOTTERY GAME AND ASSOCIATED METHOD

(75) Inventor: Mark G. Meyer, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 35 days.

(21) Appl. No.: 13/105,112

(22) Filed: May 11, 2011

(65) Prior Publication Data

US 2011/0281629 A1 Nov. 17, 2011

Related U.S. Application Data

(60) Provisional application No. 61/334,818, filed on May 14, 2010.

(51) Int. Cl.
*A63F 9/24* (2006.01)

(52) U.S. Cl.
USPC ..... 463/17; 463/42; 273/138.1

(58) Field of Classification Search
None
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | Nugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |

(Continued)

FOREIGN PATENT DOCUMENTS

| | | |
|---|---|---|
| AU | B-18428/92 | 12/1992 |
| AU | B-21070/92 | 7/1993 |

(Continued)

OTHER PUBLICATIONS

'Are You in?', (Article).

(Continued)

*Primary Examiner* — Melba Bumgarner
*Assistant Examiner* — George Howarah
(74) *Attorney, Agent, or Firm* — Dority & Manning, P.A.

(57) ABSTRACT

A lottery game method and associated system include offering a plurality of different draw-type lottery games to players, with each of the lottery games having a different game theme and respective rules of play. Lottery tickets are issued to the players in the different lottery games, with each lottery ticket having a grid of uniquely identifiable positions displayed thereon. The number of grid positions may vary between the different lottery games. In a single drawing event, grid positions are randomly and sequentially drawn in a number so as to encompass all of the different types of grids for the respective different lottery games. The sequential order in which the grid positions were drawn is provided to the players and prizes are determined for winning lottery tickets in each of the different lottery games as a function of the order in which the grid positions are sequentially and randomly drawn.

18 Claims, 5 Drawing Sheets

U.S. PATENT DOCUMENTS

| | | | |
|---|---|---|---|
| 4,191,376 | A | 3/1980 | Goldman et al. |
| 4,194,296 | A | 3/1980 | Pagnozzi et al. |
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumder |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,738,473 | A | 4/1988 | Meloni et al. |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | DiRe et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,964 | A | 12/1989 | Klinge |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnsen et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A | 8/1994 | Heidel et al. |
| 5,342,049 | A | 8/1994 | Wichinsky et al. |
| 5,344,144 | A | 9/1994 | Canon |
| 5,346,258 | A | 9/1994 | Behn et al. |
| 5,380,007 | A | 1/1995 | Travis et al. |
| 5,393,057 | A | 2/1995 | Marnell, II et al. |
| 5,401,024 | A | 3/1995 | Simunek |
| 5,403,039 | A | 4/1995 | Borowski, Jr. et al. |
| 5,407,199 | A | 4/1995 | Gumina |
| 5,411,260 | A | 5/1995 | Smith |
| 5,420,406 | A | 5/1995 | Izawa et al. |
| 5,432,005 | A | 7/1995 | Tanigami et al. |
| 5,451,052 | A | 9/1995 | Behm et al. |
| 5,453,602 | A | 9/1995 | Hanada |
| 5,456,465 | A | 10/1995 | Durham |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlein et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beaty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| RE35,864 | E | 7/1998 | Weingardt |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |
| 5,803,504 | A | 9/1998 | Deshiens et al. |
| 5,816,920 | A | 10/1998 | Hanai |
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz et al. |
| 5,836,086 | A | 11/1998 | Elder |
| 5,836,817 | A | 11/1998 | Acres et al. |
| 5,848,932 | A | 12/1998 | Adams |

| | | | |
|---|---|---|---|
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawandy et al. |
| 5,911,418 | A | 6/1999 | Adams |
| 5,915,588 | A | 6/1999 | Stoken et al. |
| 5,934,671 | A | 8/1999 | Harrison |
| 5,935,002 | A | 8/1999 | Falciglia |
| 5,970,143 | A | 10/1999 | Schneier et al. |
| 5,979,894 | A | 11/1999 | Alexoff |
| 5,996,997 | A | 12/1999 | Kamille |
| 5,997,044 | A | 12/1999 | Behm et al. |
| 6,003,307 | A | 12/1999 | Naber et al. |
| 6,004,207 | A | 12/1999 | Wilson, Jr. et al. |
| 6,007,162 | A | 12/1999 | Hinz et al. |
| 6,012,982 | A | 1/2000 | Piechowiak et al. |
| 6,014,032 | A | 1/2000 | Maddix et al. |
| 6,017,032 | A | 1/2000 | Grippo et al. |
| 6,024,641 | A | 2/2000 | Sarno |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,176,487 | B1 | 1/2001 | Eklund et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,596 | B1 | 4/2001 | Horan |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,241,246 | B1 | 6/2001 | Guttin et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,514,144 | B2 | 2/2003 | Riendeau et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,645,071 | B2 | 11/2003 | Perrie et al. |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,855,055 | B2 | 2/2005 | Perrie et al. |
| 6,875,105 | B1 | 4/2005 | Behm et al. |
| 6,929,186 | B2 | 8/2005 | Lapstun |
| 6,955,353 | B2 | 10/2005 | Taylor et al. |
| 6,988,948 | B2 | 1/2006 | Perrie et al. |
| 7,699,314 | B2 | 4/2010 | Bozeman |
| 8,056,900 | B2 | 11/2011 | Bozeman |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0082071 | A1 | 6/2002 | Riendeau et al. |
| 2002/0084335 | A1 | 7/2002 | Ericson |
| 2002/0125637 | A1* | 9/2002 | Leis ..... 273/272 |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0064773 | A1* | 4/2003 | Baerlocher et al. ..... 463/16 |
| 2003/0114210 | A1 | 6/2003 | Meyer et al. |
| 2004/0036212 | A1 | 2/2004 | Walker et al. |
| 2004/0076310 | A1 | 4/2004 | Hersch et al. |
| 2004/0173965 | A1 | 9/2004 | Stanek |
| 2004/0178579 | A1 | 9/2004 | Lowell et al. |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0229674 | A1 | 11/2004 | Thomas |
| 2004/0259631 | A1 | 12/2004 | Katz et al. |
| 2004/0266514 | A1 | 12/2004 | Penrice |
| 2006/0151943 | A1 | 7/2006 | Bozeman |
| 2006/0258433 | A1* | 11/2006 | Finocchio et al. ..... 463/16 |
| 2007/0003144 | A1* | 1/2007 | Landstad ..... 382/189 |
| 2007/0187888 | A1* | 8/2007 | Dures et al. ..... 273/138.1 |
| 2009/0124324 | A1* | 5/2009 | Malle et al. ..... 463/17 |
| 2010/0167806 | A1 | 7/2010 | Martineck, Sr. |
| 2010/0273548 | A1 | 10/2010 | Bozeman |

FOREIGN PATENT DOCUMENTS

| | | |
|---|---|---|
| AU | A-50327/96 | 2/1997 |
| AU | B-52499/96 | 2/1997 |
| AU | 199716432 | 9/1997 |
| AU | A-45403/97 | 4/1998 |
| AU | A-63553/98 | 10/1998 |
| DE | 2938307 | 4/1981 |
| DE | 3035898 | 4/1982 |
| DE | 3035947 | 5/1982 |
| DE | 2938307 | 6/1982 |
| DE | 29803107 | 8/1988 |
| DE | 3822636 | 1/1990 |
| DE | 2938307 C3 | 8/1990 |
| DE | 3415114 | 10/1995 |
| DE | 19646956 | 5/1998 |
| DE | 19706286 | 5/1998 |
| DE | 29816453 | 4/1999 |
| DE | 19751746 | 5/1999 |
| EP | 0122902 B1 | 4/1984 |
| EP | 0333934 A1 | 9/1989 |
| EP | 0458623 B1 | 11/1991 |
| EP | 0798676 | 10/1997 |
| EP | 0799649 A1 | 10/1997 |
| EP | 0799649 B1 | 12/1997 |
| EP | 0149712 A2 | 7/1998 |
| EP | 0874337 | 10/1998 |
| EP | 0896304 | 2/1999 |
| EP | 0914875 | 5/1999 |
| EP | 0919965 | 6/1999 |
| EP | 0983801 A2 | 3/2000 |

| | | | |
|---|---|---|---|
| EP | 0983801 | A3 | 3/2001 |
| EP | 1149712 | | 10/2001 |
| ES | 2006400 | | 4/1989 |
| ES | 2006401 | | 4/1989 |
| GB | 642892 | | 9/1950 |
| GB | 1495121 | | 12/1977 |
| GB | 2075918 | | 11/1981 |
| GB | 2222712 | | 3/1990 |
| GB | 2230373 | | 10/1990 |
| GB | 2295775 | | 12/1996 |
| GB | 2328311 | | 2/1999 |
| GB | 2 383 544 | | 7/2003 |
| JP | 02235744 | | 9/1990 |
| JP | 04132672 | | 5/1992 |
| WO | WO85/02250 | | 5/1985 |
| WO | WO91/17529 | | 11/1991 |
| WO | WO 98/03910 | | 1/1998 |
| WO | WO 98/40138 | | 9/1998 |
| WO | WO 99/09364 | | 2/1999 |
| WO | WO 99/26204 | | 5/1999 |
| WO | WO 99/39312 | | 8/1999 |
| WO | WO00/00256 | | 1/2000 |
| WO | WO00/78418 | | 12/2000 |
| WO | WO01/74460 | | 11/2001 |
| WO | WO01/93966 | | 12/2001 |
| WO | WO02/056266 | | 7/2002 |
| WO | WO 02087713 | | 11/2002 |

OTHER PUBLICATIONS

'Beginner's Guide—How to Bet', (www.plimico.com/How+to+wager/beginnersguide/), (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article), 1995, 1998, 10 Pgs., (http://conielco.com/faq/keno.html).

'Horse betting Tutorial—Types of Bets' (www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994, 2 Pgs., Issue 07431791, Boston Globe, Boston, MA.

'Maryland Launches Let It Ride', (Internet Article), Circa 2001,1 Pg.

'Notice of Final Rulemaking', (Internet Article) Mar. 24, 2000, 10 Pgs., vol. 6, Issue #13, Arizona Administrative Register, Arizona.

'How to Play Megabucks', (Internet Article), Mar. 9, 2001, 2 Pgs., Oregon Lottery Megabucks,(http://www.oregonlottery.org/mega/m.sub.--howto.htm).

'How to Play Megabucks', (Internet Article), May 8, 2001, 2 Pgs., Oregon Lottery Megabucks, (http://www.oregonlottery.org/mega/m.sub.--howto.htm).

'Oregon Lottery', (Internet Article), Apr. 30, 2004, 9 Pgs., Oregon Lottery Web Center, (http://www.oregonlottery.org/general/g.sub.--hist.shtml).

'Powerball Odd & Prizes', 'How to Play Powerball', (Internet Article),Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn to Play the Races' (Internet Article), 15 Pgs., Racing Daily Form (www.drf.com).

Mike Parker, 'The History of Horse Racing' (Internet Article),1996,1997,1998, 5 Pgs., http://www.mrmike.com/explore/hrhist.htm.

* cited by examiner

34

| Drawing Results 04/07/2010 | | | |
|---|---|---|---|
| 1st: | 4 | 16th: | 29 |
| 2nd: | 25 | 17th: | 27 |
| 3rd: | 7 | 18th: | 23 |
| 4th: | 24 | 19th: | 3 |
| 5th: | 5 | 20th: | 1 |
| 6th: | 6 | 21st: | 22 |
| 7th: | 18 | 22nd: | 20 |
| 8th: | 26 | 23rd: | 17 |
| 9th: | 28 | 24th: | 14 |
| 10th: | 15 | 25th: | 12 |
| 11th: | 11 | 26th: | 10 |
| 12th: | 13 | 27th: | 8 |
| 13th: | 16 | 28th: | 2 |
| 14th: | 19 | 29th: | 9 |
| 15th: | 21 | 30th: | 30 |

34

| Drawing Results 04/07/2010 | | | |
|---|---|---|---|
| 1st: | 4 | 16th: | 29 |
| 2nd: | 1 | 17th: | 27 |
| 3rd: | 7 | 18th: | 24 |
| 4th: | 23 | 19th: | 3 |
| 5th: | *Wild Ball* | 20th: | 25 |
| 6th: | 6 | 21st: | 22 |
| 7th: | 18 | 22nd: | 20 |
| 8th: | 26 | 23rd: | *Wild Ball* |
| 9th: | 9 | 24th: | 14 |
| 10th: | 15 | 25th: | 12 |
| 11th: | 11 | 26th: | 10 |
| 12th: | 13 | 27th: | 8 |
| 13th: | 16 | 28th: | 2 |
| 14th: | 19 | 29th: | 28 |
| 15th: | 21 | 30th: | 30 |

GRID-BASED MULTI-LOTTERY GAME AND ASSOCIATED METHOD

PRIORITY CLAIM

The present application claims priority to U.S. Provisional Application Ser. No. 61/334,818, filed May 14, 2010.

FIELD OF THE INVENTION

The present invention relates generally to a lottery game system and method, and more particularly to grid-based game wherein a randomized generation of grid positions may be used to play a plurality of different types of lottery games.

BACKGROUND

Draw-type lottery games are well known wherein players select (or are randomly assigned) a set of player indicia from a field of indicia. For example, POWERBALL is a popular multi-state game wherein players select five numbers from the field of numbers 1 through 59 ("5/59" draw), and 1 number from a field of numbers 1 through 39 ("1/39" draw). At a subsequent drawing conducted by the lottery authority, five numbers are randomly generated from the field of fifty-nine numbers, and one number is randomly generated from the field of thirty-nine numbers. A win is determined for the player by matching one of nine possible match combinations. Various "pick-3", "pick-4", and other types of draw games are also well known.

With the typical draw-type games, a defined subset of indicia is randomly generated by the lottery from the field of indicia, and a win is determined by players simply comparing their selected player indicia to the randomly drawn lottery indicia, with the prize typically determined as a function of the number of matches. In certain games, the order of the matches may also be considered in the prize determination. A disadvantage of these conventional draw-type games is that the randomly generated set of lottery indicia has the same value to all players and is limited to use for one type of game. For example, the random generation of numbers in the 5/59 POWERBALL game applies only to a particular POWERBALL game. States or other jurisdictions often host a number of different types of draw games, with each such game requiring its own random draw event. This adds to the complexity and expense of the individual games.

In addition, the conventional random draw events are limited in their versatility and ability to generate additional excitement and interest in the game. For example, with the conventional POWERBALL game, the 5/59 draw generates the same five numbers for all players. Once the draw is conducted, all that remains is to compare the player's numbers to the drawn numbers to determine whether or not a particular ticket is a winner.

The lottery industry would benefit from a method and related system that increases the versatility and utility of the draw event beyond application to only one particular game that simply generates the same set of indicia for all players in the same game. The present invention provides just such a method and related system.

SUMMARY

Objects and advantages of the invention will be set forth in the following description, or may be obvious from the description, or may be learned through practice of the invention. It is intended that the invention include modifications and variations to the system and method embodiments described herein.

The present invention provides a unique lottery game method and associated system wherein a plurality of lottery tickets are offered to players for different draw-type lottery games. Each off the lottery games has a different game theme and respective rules of play, prizes, and so forth. The different games may have different prize structures and odds of winning based on the number of positions in their respective grid.

In a particular embodiment, the lottery tickets are printed at game terminals at the time of purchase of the tickets. In an alternate embodiment, the tickets may be pre-printed and supplied to a lottery retailer for subsequent sale. In yet another embodiment, the tickets may be delivered or provided in electronic form, for example via the Internet or a player's mobile device.

Each of the lottery tickets includes a grid of uniquely identifiable positions displayed thereon. For example, the grid positions may be identified by individual numbers, coordinates, and any other suitable identification means. The grids are different for the different lottery games. For example, the number of grid positions may vary between the different lottery games.

A single drawing event is conducted that applies to all of the different lottery games. In this event, grid positions are randomly and sequentially drawn in a number so as to encompass all of the different types of grids for the respective different lottery game. For example, there may be five different lottery games each using a respective grid. One of the games may use a grid utilizing thirty grid positions while the other games use a grid with a lesser number of grid positions. In the drawing event, at least thirty grid positions will be randomly and sequentially drawn so as to encompass all of the games. In still another embodiment, a plurality of separate drawings may be conducted for the respective different games using the same grid.

The grid positions and order in which they are drawn are presented to the players in the various games by any suitable manner. Prizes are determined for winning lottery tickets in each of the different lottery games as a function of the order in which the grid positions are sequentially and randomly drawn, which will determine the number of matches in a game as a function of the number of grid positions drawn.

In a particular embodiment, a first one of the lottery games includes randomly populating the grids on each ticket in the game with indicia from a field of indicia that is unique to the lottery game such that each indicia is located in a respective grid position and the entire field of indicia is randomly populated into each grid. For example, the field of indicia may be a range of numbers or the complete alphabet, and so forth, and each number or letter in the field is randomly populated into the grid. The grid may contain additional positions that include a bonus feature or "wild" position. Because the field is randomly populated into the respective grids on an individual ticket basis, the populated grids vary between different lottery tickets in the same lottery game. In other words, each ticket may contain a grid with all of the letters of the alphabet, but the location of the letters within the grid will vary from ticket to ticket.

In a particular embodiment, a set of player indicia is also indicated on each lottery ticket and includes a randomly generated or player-selected subset of the field of indicia for the particular lottery game. For example, the field of indicia may be the alphabet and the set of player indicia may be a set of letters that are randomly generated for the player or selected by the player at the time they request their ticket. A win in this first lottery game is a function of the number of grid positions drawn prior to matching all of the player indicia in the grid on the respective lottery ticket.

The embodiment discussed above may include a second lottery game that includes randomly designating the grid positions on the lottery tickets without necessarily assigning additional indicia to the grid positions. A win in this game may be a function of forming a predefined pattern in the grid using a predefined number of the randomly drawn grid positions that is less than all of the grid positions. For example, a player may need to form a square, "X", or other pattern with the first ten randomly selected grid positions to win the game.

A theme of one of the lottery games may include a puzzle that is solved by a set of player indicia wherein, as in the first game discussed above, the player indicia is a subset of a field of indicia that is randomly populated in a grid on the ticket. For example, the field of indicia may be the letters of the alphabet, and the set of player indicia comprises letters needed to solve a word puzzle. In an alternate embodiment, the field of indicia may be numbers within a defined range, and the set of player indicia may be numbers within the range needed to solve a number puzzle, such as a Sudoku game. Multiple lottery tickets within the same game may have the same puzzle solved by the same set of player indicia. The lottery tickets are still different because the set of player indicia is randomly populated into different grid positions between the respective lottery tickets. Players could also solve different puzzles using the randomized indicia revealed in drawn cell as long as each of the puzzles is missing the same number of indicia A second one of the lottery games may include randomly populating the grids on each ticket with indicia from a field of indicia that is different than the field of indicia in the first lottery game. As with the first game, a set of player indicia is randomly generated or selected by the player as a subset of the field of indicia. A win in the second lottery game is a function of the number of grid positions drawn prior to matching all of the player indicia on the respective lottery ticket. With this scenario, the field of indicia for the second one of the lottery games may be numbers within a defined range and the set of player indicia comprises a subset of the numbers needed to solve a number puzzle, while the field of indicia for the first game may be the alphabet and the set of player indicia comprises a group of letters needed to solve a word puzzle.

In another embodiment, at least one of the randomly generated grid positions is a "wild" (or "free") position that may be used by a player to select any position on their respective lottery ticket grid. For example, the player may need one particular letter, number, or other indicia to complete the match of all of their player indicia. If the wild position is drawn, the player may immediately apply such position to the location of the missing indicia in their grid.

The invention also encompasses a system that is uniquely configured to host the multiple lottery games discussed above. Such a system may include, for example, a communication network that links a plurality of game terminals to a lottery server. The system includes a plurality of lottery tickets that are made available to players for each of the different lottery games. These tickets may be printed by the game terminals, with each of the lottery tickets having a grid of uniquely identifiable positions displayed thereon. The number of grid positions varies between the different lottery games. The game terminals are configured to transmit information on each issued ticket to the server, with the server storing a record of each ticket issued that includes the transmitted information.

The server receives the results of a single drawing event wherein grid positions are randomly and sequentially drawn in a number sufficient to encompass all of the different types of grids for the respective different lottery games, with the sequential order of the drawn grid positions provided to the players. The server may conduct this random drawn event, or receive the results from an independent drawn event, such as a periodic televised lottery drawing. The server is configured to determine winning tickets from the stored records and determine prizes for winning lottery tickets as a function of the order in which the grid positions are sequentially and randomly drawn.

In a unique system embodiment, the game terminals may contain instructions or programming for randomly populating the grids on each ticket of a first one of the lottery games with indicia from a field of indicia that is unique to the first lottery game such that each indicia is located in a respective grid position and the entire field of indicia is randomly populated into each grid. It should also be understood that the randomized grids on the respective tickets may be algorithmically "predefined" and stored on a game server. Upon purchase, these predefined tickets are simply retrieved and distributed to players either randomly or in sequential order. In this sense, "predefined" does not mean that the outcome of the game for any respective ticket is predetermined (a win or loss is determined by the subsequent draw process), but only that the randomized grids are defined and stored before purchase.

The game terminals also indicate a set of player indicia on each lottery ticket in the lottery game, with the set of player indicia comprising a randomly generated or player-selected subset of the field of indicia for the particular lottery game. In this embodiment, the server is configured to determine a win in the first lottery game as a function of the number of grid positions drawn prior to matching all of the player indicia on the respective lottery ticket.

For hosting a second one of the lottery games, the game terminals may be configured for randomly designating the grid positions on the lottery tickets within the lottery game, for example by randomly assigning numbers, coordinates, or other identifiers to the grid positions. The server is configured to determine a win in the lottery game as a function of forming a predefined pattern (or satisfying some other requirement) in the grid using a predefined number of the randomly drawn grid positions that is less than all of the grid positions.

In still another system embodiment, the game terminals may be configured to provide the lottery tickets for the first one of the lottery games with a puzzle that is solved by the set of player indicia. A plurality of the lottery tickets may have the same puzzle solved by the same set of player indicia, with the game terminals randomly populating the field of indicia into different grid positions between the respective lottery tickets.

Alternatively, the game terminals may be further configured for randomly populating the grids on each ticket in a second one of the lottery games with indicia from a field of indicia that is different than the field of indicia in the first lottery game such that each grid position contains at least one indicia and the entire field of indicia is randomly populated into each grid. The game terminals indicate a set of player indicia on each lottery ticket in the second lottery game that may include a randomly generated or player-selected subset of the field of indicia for the second lottery game, with the server configured to determine a win in the second lottery game as a function of the number of grid positions drawn prior to matching all of the player indicia on the respective lottery ticket.

The server and associated game terminals may be further configured to carry out any of the game features in any of the various embodiments disclosed or enabled herein, and all such configurations are within the scope and spirit of the present invention.

Additional aspects of particular embodiments of the invention will be discussed below with reference to the appended figures.

DETAILED DESCRIPTION

Figure 1:
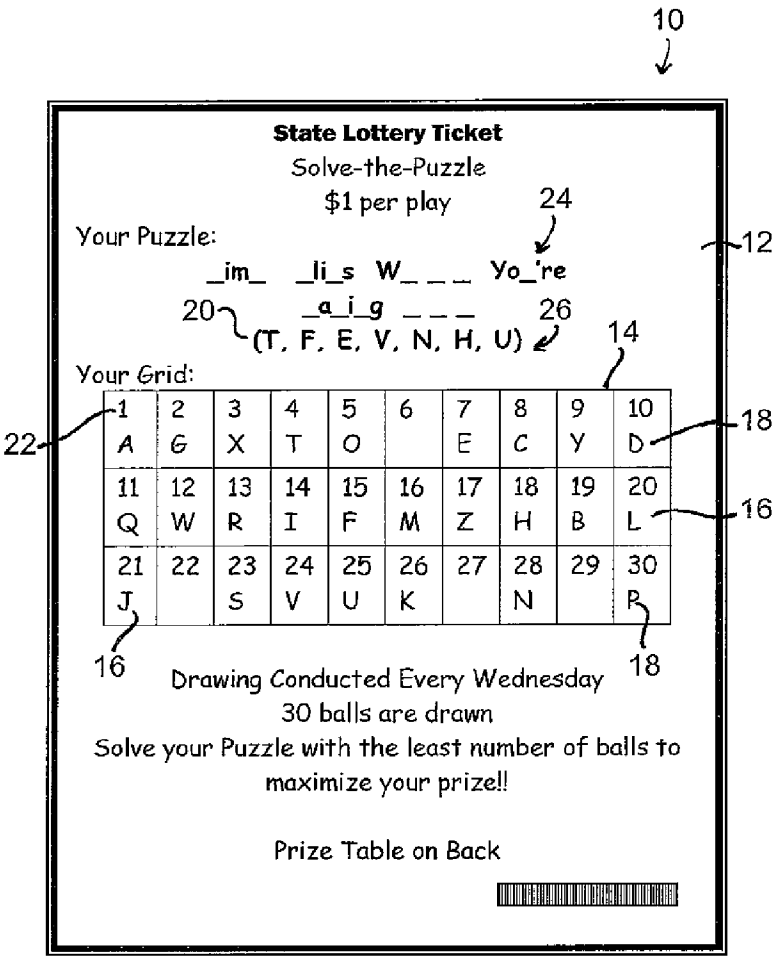
FIG. 1 is a front planar view of an embodiment of a game ticket for a first type of lottery game in accordance with aspects of the invention.

Reference will now be made in detail to certain embodiments of the system and methodology in accordance with aspects of the invention, examples of which are illustrated in the drawings. Each embodiment is provided by way of explanation of the invention, and is not meant as a limitation of the invention. For example, features illustrated and described as part of one embodiment may be used with another embodiment to yield still a further embodiment. It is intended that the present invention include these and other modifications and variations as come within the scope of the appended claims and their equivalents.

FIG. 1 illustrates an exemplary embodiment of a lottery ticket 10 for one of the games that may be played in accordance with aspects of the invention. The ticket 10 illustrates features that would be included with the various tickets for all of the different types of games. The lottery ticket 10 may be provided to lottery players on any manner of substrate 12. For example, the lottery ticket 10 may be printed at a lottery terminal printer onto stock paper, or the pre-printed and provided to lottery retailers in the form of individual tickets. The tickets 10 may be provided in a virtual electronic form to a player's Internet-enabled device. The present invention is not limited by the manner in which the tickets 10 are provided to lottery players.

The lottery tickets 10 include any manner of graphics, printing, or other indicia that advertises the game, provides instructions, displays a theme of the particular game, and so forth. In the embodiment of FIG. 1, the game of ticket 10 relates to a word puzzle theme, as will be described in greater detail below. It should be readily appreciated that the lottery tickets 10 may be conformed to any desired game, game structure, or game theme in accordance with aspects of the invention.

Each lottery ticket 10 distributed to players for any one of the different games includes a grid 14. The grid 14 may be represented in any conventional manner, and need not be in a rectangular or square configuration as illustrated in the figures. For example, the grid 14 may comprise a circular configuration, serial or linear configuration, pie sector configuration, and so forth. The term "grid" is used herein to refer to a compilation of individual positions 16 in any identifiable manner or pattern. The grid 14 includes a plurality of grid positions 16, with each grid position 16 including a unique identifier 22. In the illustrated embodiment, each grid position 16 includes a number as the unique grid identifier 22. In an alternate embodiment, the grid 14 may be illustrated with a coordinate system wherein columns and rows are separately labeled and each position in the grid may be identified by a set of the coordinates. Any manner of displaying the plurality of grid positions 16 and identifying each of the grid positions is within the scope and spirit of the invention (including the use of any combination of colors and symbols).

The plurality of games are played by conducting a drawing event that is applicable to all of the games. In this drawing event, the grid positions 16 are randomly and sequentially drawn in a sufficient number to ensure that enough grid positions 16 are drawn to satisfy the requirements of all of the different types of games. For example, there may be five different lottery games with five different respective grids 14 each having a different number of grid positions 16. One of the grids 14 may utilize thirty grid positions 16 while the other games use a lesser number of grid positions. In the drawing event, at least thirty grid positions 16 will be randomly and sequentially drawn.

Referring to FIG. 1, it should be appreciated that the grid 14 in any one of the different games may actually contain more grid positions 16 than there are indicia 18. As explained below, the game in FIG. 1 actually needs only twenty-six grid positions 16, but the grid 14 indicates thirty grid positions 16. The extra grid positions 16 (positions 6, 22, 27, and 29) will be part of the overall random and sequential draw of thirty grid positions 16, with the extra positions 16 having a different meaning or value depending on the particular game. Alternatively, the grid 14 may contain only twenty-six grid positions 16, with each position 16 including an indicia 18, as described in more detail below.

Figures 5, 6, 7:
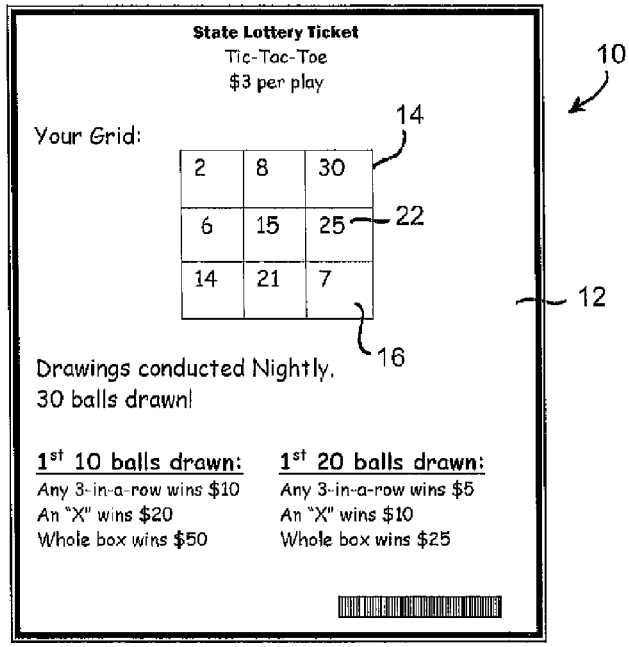
FIG. 5 is a front planar view of an embodiment of a game ticket for yet another type of lottery game in accordance with aspects of the invention.
FIGS. 6 and 7 are exemplary embodiments of tables that may be used to publish to players the order in which the grid positions are randomly and sequentially draw.

The order of the random sequential draw is recorded by noting the identifiers 22 as the grid positions 16 are drawn. The grid positions 16 and order in which they are drawn are presented to the players in the various games by any suitable manner. For example, the order may be presented in the form of tables 34 as depicted in FIGS. 6 and 7, which may be published to the players by any suitable means. Prizes are determined for winning lottery tickets in each of the different lottery games as a function of the order in which the grid positions 16 are sequentially and randomly drawn.

An exemplary first one of the plurality of different lottery games is depicted by the ticket 10 in FIG. 1. In this particular type of game, a field of indicia 18 is randomly populated into the grid 14. The indicia 18 may be any defined set of indicia. For example, in the illustrated embodiment, the field of indicia is the complete set of letters in the alphabet A-Z. In an alternate embodiment, the field of indicia may be the numbers within a defined range, for example the numbers from 1 to 50. In still another embodiment, the field of indicia may be a defined set of symbols or pictures. For example, the field of indicia may be all of the names or mascots for the NFL (National Football League) football teams or the NHL (National Hockey League) hockey teams, and so forth. The invention is not limited by the particular defined field of indicia.

In the particular game of FIG. 1, the grid 14 of each lottery ticket 10 is randomly populated with the indicia 18 from the complete field of indicia such that each of the indicia 18 in the field is located in a respective grid position 16 and the entire set of indicia is randomly populated into the grid 14. For example, in FIG. 1, all twenty-six letters of the alphabet are randomly populated into the grid 14 such that each letter is in a respective grid position 16. Grid positions 16 identified as "6", "22", "27", and "29" do not contain a letter in the grid 14 for this particular ticket. On other tickets in the same game, four other grid positions 16 may be "blank." In play of the game, if a grid position is selected in the random draw event that does not contain an indicia 18 on a particular ticket 10, then such grid position 16 is a "pass" or "wasted" position for that respective ticket 10. It should thus be appreciated that, although each ticket in the game will include a grid 14 containing the entire field of indicia, the individual tickets are different from each other in the manner in which the field of indicia is randomly populated into the grid 14. For example, referring to FIG. 1, each ticket 10 in the game will have a grid 14 containing the complete alphabet, but the individual letters are located in different grid positions 16 within the respective grids 14. In this way, the players are revealed indicia that is unique to their respective ticket based upon the random drawing of indicia (cell positions) that is common to all of the tickets.

For a particular type of game depicted in FIG. 1, each ticket 10 may also include a set of player indicia 20 that is a subset of the field of indicia contained within the grid 14. This subset 20 is randomly generated from the complete field of indicia and has a defined number of indicia that is less than the complete field of indicia. Referring to FIG. 1, for example, the player indicia 20 is the set of seven letters T, F, E, V, N, H, and U randomly generated from the letters A-Z of the alphabet. It should be appreciated that it is not necessary for the missing indicia to actually be printed or displayed on the ticket.

In the illustrated embodiments, the set of player indicia 20 is randomly generated and provided to the player. It should be appreciated, however, that an alternate embodiment within the scope of the invention allows the player to select their set of player indicia 20 from the field of indicia. For example, the player may be presented with a play slip wherein the player marks seven letters of the alphabet as their set of player indicia 20. The play slip is presented to a retailer and scanned or otherwise entered into a game terminal that prints the ticket 10 with the player selected set of indicia 20.

The lottery game for the ticket of FIG. 1 is played with the subsequent drawing event wherein positions 16 in the grid are randomly and sequentially drawn. This drawing event may be a scheduled event that is conducted by the lottery authority. For example, one such event may include the random drawing of balls from a machine, wherein each ball includes one of the grid position indicators 22. In the example of FIG. 1, the ball machine would include at least twenty-six balls, with the balls labeled 1 through 26, and may include additional balls above the number of indicia 18 in the field of indicia. The balls are randomly and sequentially drawn until either a predefined number or all of the balls have been selected. For example, if only the first twenty balls drawn are relevant to the prize structure, then all of the balls need not be drawn (but may be for increased entertainment value). If another game requires that thirty balls be drawn, then all thirty will be drawn with only the first twenty balls being applicable to the game for the ticket 10 of FIG. 1.

The grid positions are individually drawn one at a time and the order in which the balls are drawn is recorded. FIG. 6 illustrates the recordation of the drawing event for drawing thirty grid positions 16. The first drawn position is grid position 4. The second draw is grid position 25, and so forth. The last draw is gird position 30. It should be appreciated that any conventional and known random generation machine, mechanical device, program, and the like, may be utilized by the lottery authority to sequentially and randomly draw the grid positions or simulate drawing the grid positions. The drawing event may be televised or otherwise publicly displayed, or may be conducted by the lottery authority in a non-public manner with the results subsequently provided to the players in the way of a table, publication, web posting, and so forth.

Figure 2:
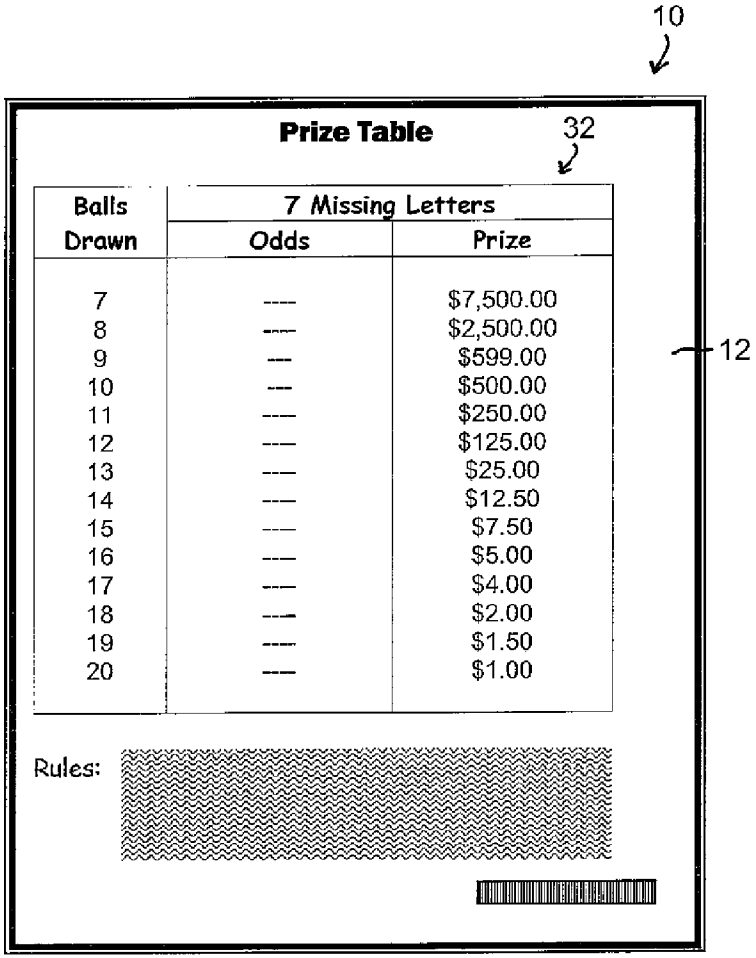
FIG. 2 is a depiction of a prize/odds table that may be associated with the game of the ticket in FIG. 1, and which may be provided on the back of the ticket.
Figure 3:
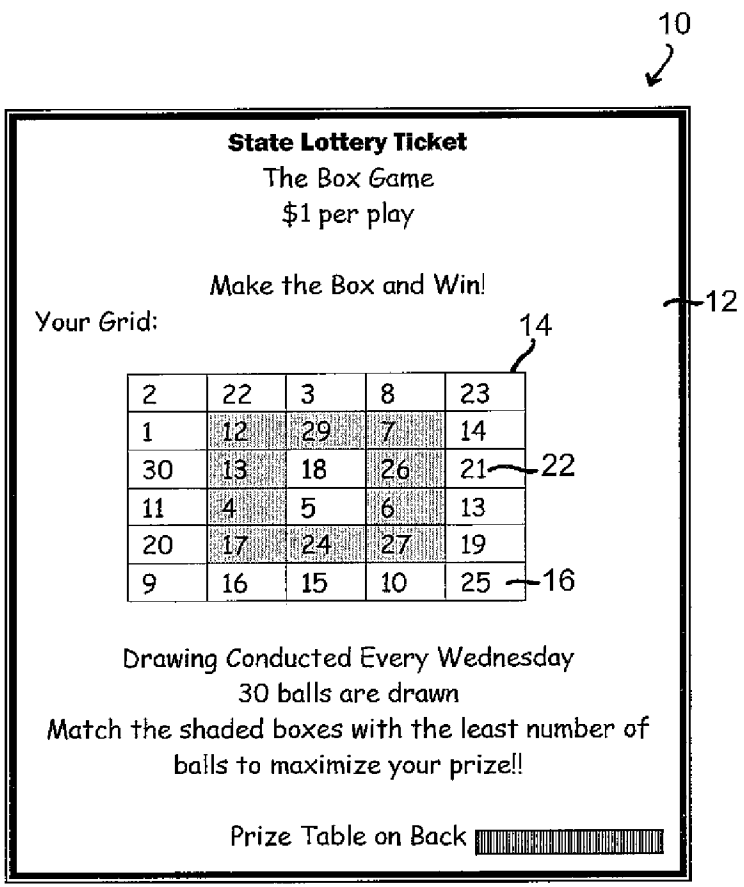
FIG. 3 is a front planar view of an embodiment of a game ticket for a second type of lottery game in accordance with aspects of the invention.

Still referring to the game depicted in the ticket 10 of FIG. 1, winning tickets and prizes are determined as a function of the number of the sequentially and randomly drawn grid positions that are needed to match all of the player indicia for a respective lottery ticket 10. For example, referring to FIG. 2, a prize/odds table 32 may be provided on the back of the lottery ticket 10 for the player's reference. In the alphabet indicia example of FIG. 1, the seven letters in the set of player indicia 20 are all contained within the grid 14, and all of the grid positions 16 were sequentially and randomly drawn. In a best possible scenario, the seven letters in the set of player indicia 20 will correspond to the first seven grid positions drawn, which results in a maximum prize as indicated in FIG. 3. As the number of grid positions increase before all seven letters are satisfied, the prizes decrease in value. For example, referring to FIG. 2, if it is necessary to draw ten grid positions before the seven letters are found in the grid, then the prize is significantly less than the top prize. The seven letters may be found in the first fifteen grid positions drawn, resulting in an even lesser prize (if any), and so forth. The lottery may define a floor or minimum prize level below which no prize is awarded. For example, referring to FIG. 2, if the seven letters in the player's set of indicia are not located within the grid within the first twenty balls selected, then no prize is awarded for that particular lottery ticket. Depending on the other games associated with the random draw event, twenty may be the maximum number of balls drawn.

In a particularly unique embodiment illustrated in FIG. 1, the lottery tickets 10 associated with one of the different types of lottery games may include a puzzle, problem, or other type of game 24 that relates to a theme for the lottery ticket. In the embodiment of FIG. 1, the theme is "Solve-the-Puzzle" and a word puzzle 24 is provided on each ticket. The word puzzle 24 includes a well-known or easily recognized phrase with certain letters from the phrase missing. The solution 26 (the missing letters) corresponds to the player's set of indicia 20. The solution 26 may be provided on the ticket for the player so that little thought is required by the player to identify their set of player indicia 20. In an alternative embodiment, the solution 26 may be hidden (for example under a scratch-off layer) or provided on the back of the ticket, or not provided at all. With this embodiment, the player is afforded the opportunity to actually complete the puzzle in order to identify their set of player indicia 20, which adds an additional entertainment value to the ticket 10. It should be appreciated that the puzzle or problem 24 may comprise any type of conventional puzzle such as a crossword puzzle, a number problem such as a Sudoku puzzle, and so forth. As discussed, the puzzles may be completely different with respect to the same common draw of grid positions. For example, in the word puzzle embodiment, various puzzles may be provided wherein the number of missing letters is the same for all puzzles, with the actual missing letters being different.

The same puzzle or problem 24 may be presented on multiple tickets within the same game and solved by the same set of player indicia 20. This particular embodiment is still within the scope and spirit of the invention in that each lottery ticket still provides a different winning scenario because the game is determined by the position of the indicia within the randomly populated grids, which differs from ticket to ticket.

Figure 4:
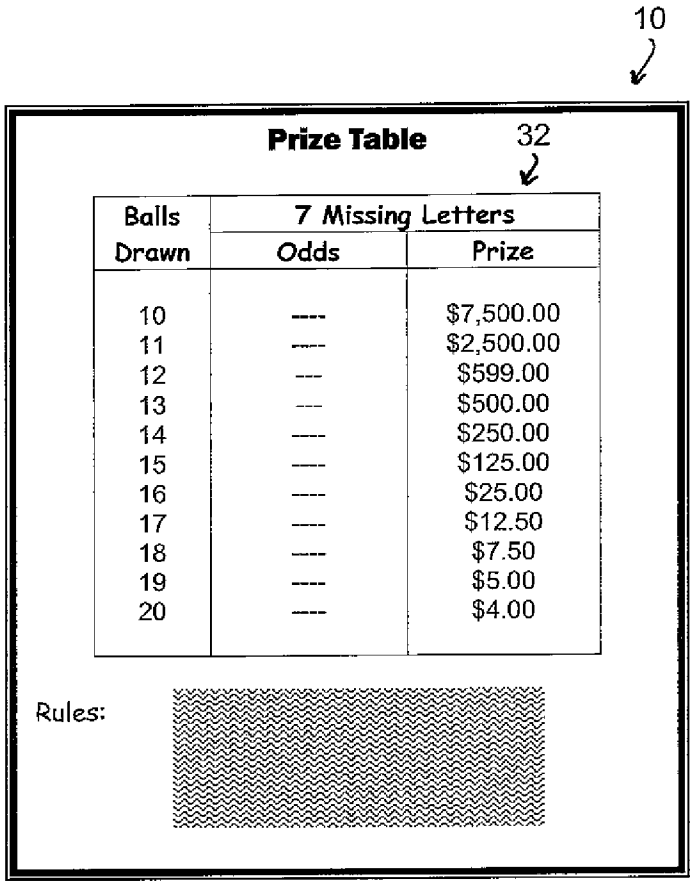
FIG. 4 is a depiction of a prize/odds table that may be associated with the game of the ticket in FIG. 3, and which may be provided on the back of the ticket.

FIGS. 3 and 4 depict a different lottery game that may be played with the same draw event that applies to the game of FIG. 1. The ticket 10 in this game includes a grid 14 having thirty grid positions 16. The positions 16 are randomly identified with identifiers 22 such that different tickets 10 within this game have different grids 14. The theme of this game is to "make a box" of the shaded grid positions 16 with the least number of drawn positions. Any other type of pattern or relationship of grid positions may be designated as objects of the game, prize values, and so forth. Referring to the prize award table 32 of FIG. 4, the top prize is awarded if the box is completed with the first ten drawn positions. The bottom prize is awarded if the box is completed with the first twenty drawn positions. This particular type of game does not use player indicia that is randomly populated into the grid 14, but relies on randomly designating the grid positions 16. As with the game of FIG. 1, it is not necessary to draw all thirty of the grid positions in the random drawing event, but this may be done for various other reasons.

FIG. 5 depicts yet another type of lottery game that may be simultaneously played with the same random drawing event used to conduct the games of FIGS. 1 and 3. The grid 14 on this ticket 10 includes nine grid positions 16 that have been randomly identified with identifiers 22 between "1" and "30". Thus, this game has another level of randomness in that all thirty grid positions are not used (as in the games of FIGS. 1 and 3). In this game, nine of thirty grid identifiers 22 are randomly selected, and the nine identifiers 22 are randomly populated into the nine grid positions 16. The theme of the game is "Tic-Tac-Toe". The thirty grid position identifiers 22 are randomly and sequentially drawn and satisfaction of any "3-in-a-row" within the first ten drawn positions is worth a greater prize value than if satisfied within the first twenty drawn positions, and so forth. With this game, all thirty grid positions are drawn. Thus, if this type of game were to be played with the games of FIGS. 1 and 3, the single draw event would randomly and sequentially draw thirty grid positions even though the games of FIGS. 1 and 3 depend only on the first twenty positions.

It is also within the scope and spirit of the invention for any one or all of the different lottery games to include a "wild" or "free" grid position in the random and sequential drawing of the grid positions. For example, referring to FIG. 7, the table 34 depicts the results of a drawing wherein the $5^{th}$ and $23^{rd}$ balls drawn were "wild balls". These wild positions allow the player to substitute any grid position they may need at that point in the game, even if that grid position is subsequently drawn. For example, the player may need one particular letter or other indicia to complete the match for all of their player indicia in the game of FIG. 1. If the wild grid position is drawn, the player may immediately apply such position to the location of the missing indicia in their grid.

In another embodiment, the "wild" or "free" positions may be randomly distributed within the grids of the respective tickets 10. With this embodiment, the grant of a "wild" position is unique to individual players and not a collective experience for all players. For example, in the game of FIGS. 1 and 2, any one of the blank grids (6, 22, 27, or 29) may contain a "wild" designation. When (if) such grid position is randomly drawn, the player may use any letter they may need in solving the puzzle.

Figure 8:
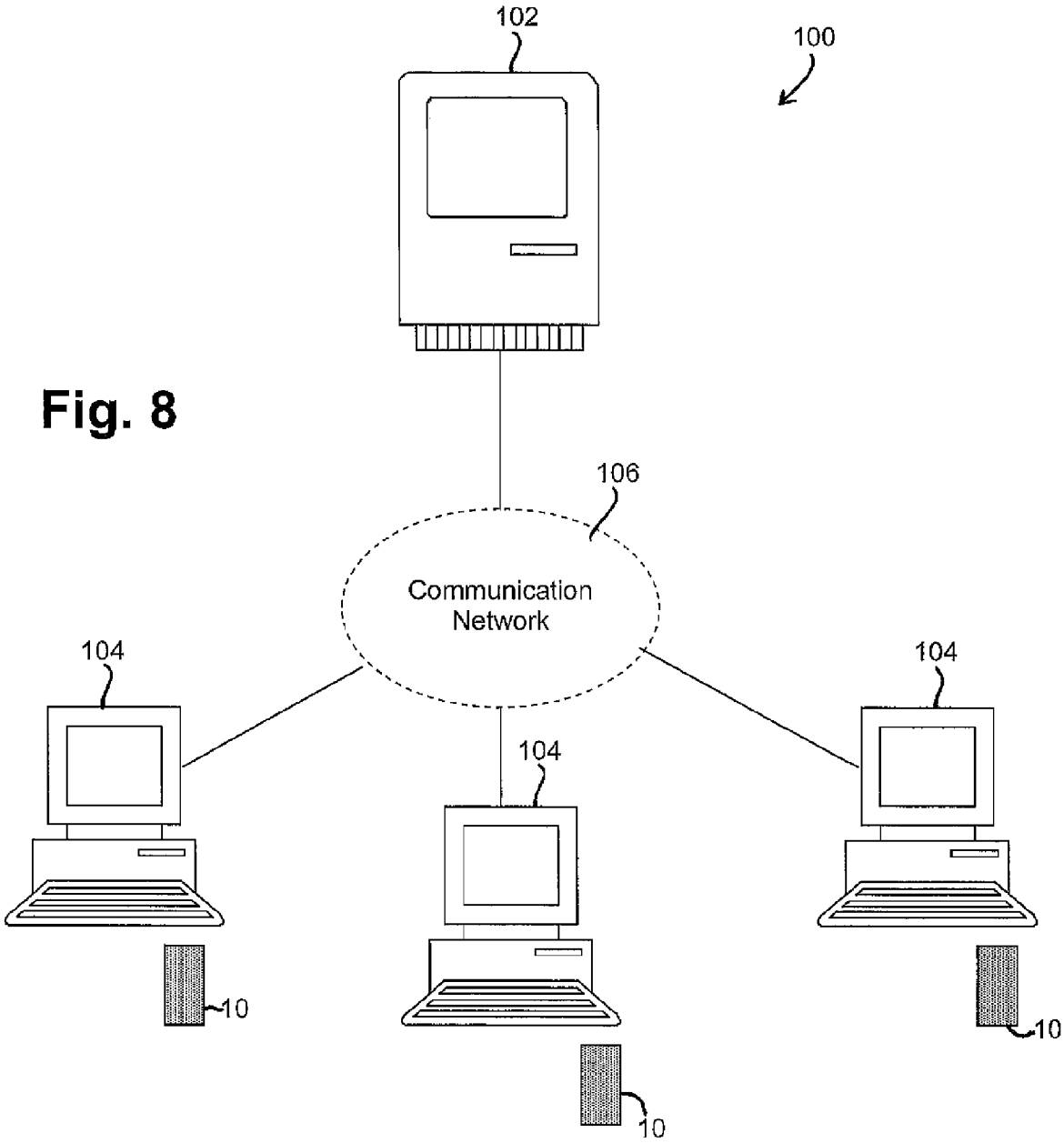
FIG. 8 is an exemplary system configuration that may be used to host a lottery game in accordance with aspects of the invention.
Figure 9:
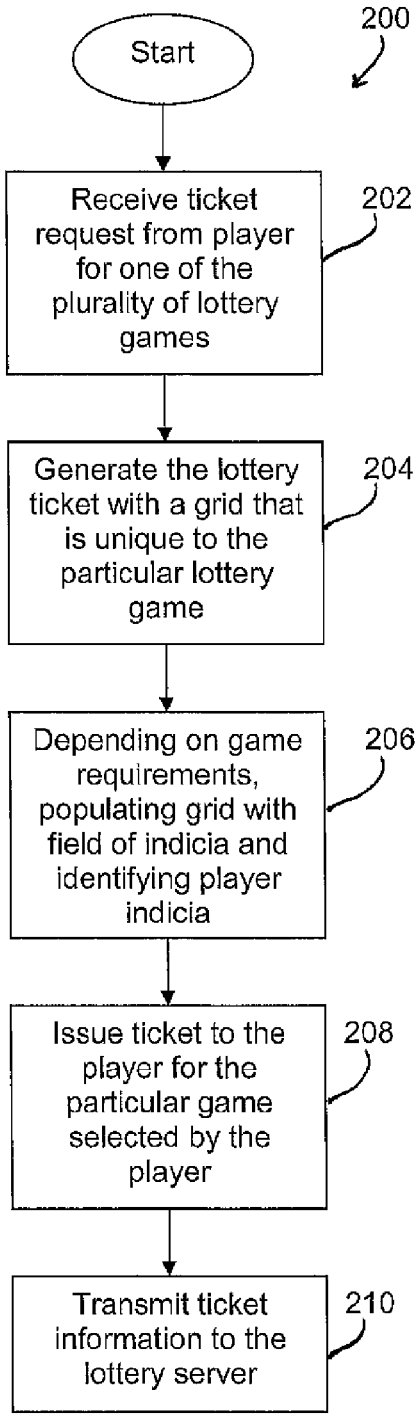
FIG. 9 illustrates an exemplary game terminal process.
Figure 10:
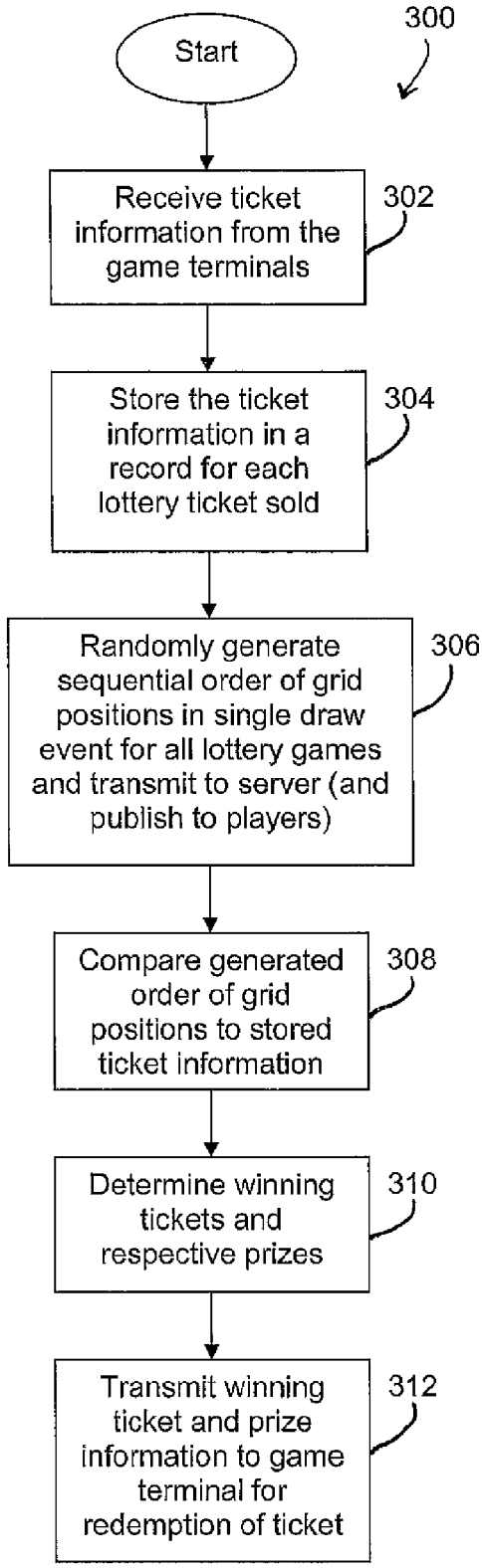
FIG. 10 illustrates an exemplary lottery server process.

Referring to FIGS. 8 through 10, the present invention also encompasses a system 100 that is uniquely configured to host the lottery game described herein. In a simplified version, the system 100 may incorporate a single stand alone gaming device having a controller configured to carry out all of the steps discussed herein necessary for hosting the multiple lottery games. In the embodiment illustrated in FIG. 8, the system 100 is configured for wide-area implementation of the games by a lottery authority, for example a state-wide lottery game, multi-state lottery game, and so forth. In this configuration, the system 100 includes a central lottery authority server 102 that is in communication with a plurality of game terminals 104. The game terminals 104 may be located at various retail establishments where the lottery tickets are offered for sale to the public. The game terminals 104 are in communication with the server 102 through any conventional communication network 106, such as a wide-area network, Internet, or any other suitable communication network.

It should also be appreciated that the invention encompasses direct sale/distribution of tickets to players via the Internet. In this regard, the player's Internet-enabled device may be considered as a game terminal 104.

Referring to FIGS. 9 and 10, players wishing to play one or more of the different lottery games make a ticket request 202 at any one of the game terminals 104. This request may be input directly by the player via a player input device configured with the game terminal 104, or the player request may be input by a clerk or other retail establishment person responsible for operating the respective game terminal 104. The present system and method also contemplate a voucher-based system wherein players purchase a voucher at a retail establishment or over the internet/mobile device that entitles the player to subsequent interactive play of one or more of the lottery games. Alternatively, the players may direct-pay for the games at the time of interactive play via a pre-arranged payment account, profile, or the like. At the time of interactive play, the players choose their desired games, drawings and/or indicia interactively over the internet or a mobile device for play of the games at their leisure.

The game terminals 104 include unique software and hardware configurations necessary to generate the different lottery tickets applicable to the different lottery games, including generating or retrieving predefined unique grids for each of the different types of games at step 204. Depending on the type of game selected by the player, the game terminals may also randomly populate the grids with a field of indicia or generate randomized grid position identifiers at step 206. At step 206, the game terminals 104 may be uniquely configured to randomly generate the set of player indicia or to accept a player's selection of player indicia via a play slip or other entry means. For example, the game terminals 104 may be equipped with a scanner that reads the player's selection of indicia from a play slip that is filled out by the players. Alternatively, the game terminals 104 may include a keyboard or other entry means by which the player's selection of indicia is entered.

At step 208, the game terminals 104 issue the different lottery tickets 10 to the player(s). The tickets 10 includes the randomized grids that are unique to the respective different games, the player's set of indicia (if applicable), and any other manner of graphics, indicia, or other information related to the particular lottery game.

At step 210, the game terminals 104 transmit information related to the issued ticket to the lottery server 102. This information may include, among other things, a unique serial number or other identification related to each individual ticket, the unique randomized grid associated with the ticket, the player's set of indicia, and so forth.

Referring to FIG. 10, aspects of the server process 300 are illustrated. At step 302, the server 102 receives the ticket information from the various game terminals 104. At step 304, the server 102 creates a record for each ticket and stores the ticket information related to each issued ticket. At step 306, the server 102 may randomly generate the sequential order of grid positions for further play of the various different games. In an alternative embodiment, the random generation of the sequential order of grid positions may be conducted at a drawing event, as discussed above, with the results of the drawing being communicated to the server 102. The results of the drawing or random generation of grid positions is published to the players by any suitable means.

At step 308, the server compares the generated order of grid positions to the stored ticket information for each of the different types of games, and determines individual winning tickets in each of the games and respective prizes at step 310.

At step 312, when winning tickets are presented by players for redemption at the game terminals 104 (or other redemption location), the server 102 retrieves the winning ticket and prize information for the respective ticket and transmits the information to the game terminal 104 or other redemption location.

It should be readily appreciated that the system configuration set forth in FIGS. 8 through 10 is an illustration of but one type of system that may be utilized. Any number of modifications to system hardware and software may be made to implement and host the lottery game, and all such modifications and variations are within the scope and spirit of the present invention.

It should be readily appreciated by those skilled in the art that various modifications and variations can be made to the embodiments illustrated and described herein without departing from the scope and spirit of the invention.

What is claimed is:

1. A computer and game terminal implemented lottery game method, comprising:

offering a plurality of different draw-type lottery games to players, each of the different lottery games having a different game theme and respective rules of play;

issuing lottery tickets to the players from a plurality of game terminals in the different lottery games, each lottery ticket having a grid of uniquely identifiable positions displayed thereon with the grids being different between the different respective lottery games, the terminals in communication with a server via a communications network;

transmitting information on each ticket issued to the server from the game terminals, the server storing a record of each ticket issued that includes the transmitted information;

in a single drawing event, randomly and sequentially drawing grid positions with a random generation device, wherein enough of the grid positions are randomly drawn so as to encompass all of the different grids for play of the respective different lottery games, and providing to the players and the server the sequential order in which the grid positions were drawn;

wherein the randomly drawn grid positions are matched to the lottery ticket grids to determine whether the respective lottery tickets are winning tickets, and prizes are determined by the server for winning lottery tickets in each of the different lottery games as a function of the order in which the grid positions are sequentially and randomly drawn such that lottery tickets that become winning lottery tickets earlier on in the random draw of grid positions win a greater prize than lottery tickets that become winning lottery tickets later on in the random draw of grid positions;

wherein one of the lottery games includes randomly populating the grids on each ticket with indicia from a first field of game indicia that is unique to the lottery game such that the entire field of indicia is randomly populated into the grids, and separately indicating a set of player indicia on each lottery ticket comprising a randomly generated or player-selected subset of the field of indicia; and wherein a win in the one of the lottery games is a function of a number of grid positions needed to match the set of player indicia with the first field of game indicia in the grid positions on the respective lottery tickets.

2. The method as in claim 1, wherein a second one of the lottery games games includes randomly designating the grid positions on the lottery tickets, and wherein a second win in the second one of the different lottery games-is a function of forming a predefined pattern in the grid using a predefined number of the randomly drawn grid positions that is less than all of the grid positions.

3. The method as in claim 1, wherein a theme of the one of the different lottery games includes a respective puzzle that is solved by the set of player indicia.

4. The method as in claim 3, the lottery tickets within the one of the lottery games have the same puzzle solved by a common set of player indicia, with the set of player indicia being randomly populated into different grid positions between the respective lottery tickets.

5. The method as in claim 1, wherein a second one of the lottery games includes randomly populating the grids on each ticket with indicia from a second field of game indicia that is different than the first field of game indicia in the one of the lottery games, and separately indicating a second set of player indicia on each lottery ticket, wherein the second set of player indicia is randomly generated or player-selected subset of the second field of game indicia for the second lottery game, and wherein a second win in the second one of the lottery games is a function of the number of grid positions drawn prior to matching all of the player indicia with the indicia in the grid on the respective lottery ticket.

6. The method as in claim 5, wherein the first field of game indicia for the one of the lottery games comprises the letters of the alphabet, and the first set of player indicia comprises letters needed to solve a word puzzle, and the second field of game indicia for the second one of the lottery games comprises numbers within a defined range, and the second set of player indicia comprises a subset of the numbers needed to solve a number puzzle.

7. The method as in claim 1, wherein at least one of the randomly generated grid positions from the drawing event is a wild position that may be used by a player to select any position on their respective lottery ticket grid.

8. The method as in claim 1, wherein each of the different lottery games includes a different prize structure and odds of winning based on the number of positions in their respective grid.

9. The method as in claim 1, wherein the grid positions are numbered on the lottery tickets, and the numbers are randomly and sequentially drawn in the single drawing event and presented to the players in the order drawn.

10. The method as in claim 1, wherein the number of grid positions on the respective lottery tickets varies between the different lottery games.

11. A system for hosting a plurality of different draw lottery games, wherein each of the different lottery games has a different game theme and respective rules of play, comprising:

a communication network;

a plurality of game terminals;

a server in communication with said game terminals via said communication network;

a plurality of lottery tickets issued in each of the different lottery games by said game terminals, each lottery ticket having a grid uniquely identified grid positions displayed thereon with the grids being different between the different respective lottery games;

said game terminals configured to issue said lottery tickets to players from a plurality of game terminals in the different lottery games, with each lottery ticket in each game having a grid of uniquely identifiable positions displayed thereon, with the grids being different between the different respective lottery games;

said game terminals further configured to transmit information on each ticket issued to said server, said server storing a record of each ticket issued that includes the transmitted information;

wherein in a single drawing event, randomly and sequentially drawing grid positions with a random generation device, wherein enough grid positions are randomly and sequentially drawn so as to encompass all of the different types of grids for play of the respective different lottery games, and the sequential order of the drawn grid positions is provided to the players;

said server further configured to determine winning tickets from the stored records and determine prizes for winning lottery tickets as a function of the order in which the grid positions are sequentially and randomly drawn such that lottery tickets that become winning lottery tickets earlier on in the random draw of grid positions win a greater prize that lottery tickets than become winning lottery, tickets later on in the random draw of grid positions;

wherein the plurality of game terminals or the server are configured for randomly populating the grids on each ticket of one of the lottery games with indicia from a first field of game indicia that is unique to the lottery game such that the entire field of indicia is randomly populated into each grid, and to separately indicate a set of player indicia on each lottery ticket in the lottery game comprising a randomly generated or player-selected subset of the field of indicia for the particular lottery game, and said server configured to determine a win in the one of the lottery games as a function of the number of grid positions drawn prior to matching all of the player indicia with the indicia on the respective lottery ticket.

12. The system as in claim 11, wherein the plurality of game terminals or the server are configured for randomly designating the grid positions in a second one of the lottery games on the lottery tickets within the lottery game, and said server configured to determine a second win in the second one of the lottery games is a function of forming a predefined pattern in the grid using a predefined number of the randomly drawn grid positions that is less than all of the grid positions on the lottery ticket.

13. The system as in claim 11, wherein the plurality of game terminals are configured to provide the lottery tickets for the one of the lottery games with a puzzle that is solved by the set of player indicia.

14. The system as in claim 13, wherein said game terminals provide the plurality of the lottery tickets for the one of the lottery games with the same puzzle solved by a common set of player indicia, said game terminals or server randomly populating the field of game indicia into different grid positions between the respective lottery tickets.

15. The system as in claim 11, wherein plurality of game terminals or the server are further configured for randomly populating the grids on each ticket in a second one of the lottery games with indicia from a second field of game indicia that is different than the first field of game indicia in the one of the lottery game, and to separately indicate a second set of player indicia on each lottery ticket in the second lottery game that comprises a randomly generated or player-selected subset of the second field of game indicia for the second lottery game, and said server configured to determine a second win in the second one of the lottery games as a function of the number of grid positions drawn prior to matching all of the player indicia with the indicia on the respective lottery ticket.

16. The system as in claim 15, wherein the first field of game indicia for the one of the lottery games comprises the letters of the alphabet, and the first set of player indicia comprises letters needed to solve a word puzzle, and the second field of game indicia for the second one of the lottery games comprises numbers within a defined range, and the second set of player indicia comprises a subset of the numbers needed to solve a number puzzle.

17. The system as in claim 11, wherein the number of grid positions on the plurality of lottery tickets varies between the different lottery games.

18. The system as in claim 11, wherein said game terminals comprise a players' Internet-enabled devices.

* * * * *